US008091274B2

(12) United States Patent
Weder

(10) Patent No.: US 8,091,274 B2
(45) Date of Patent: Jan. 10, 2012

(54) METHOD OF WRAPPING A FLORAL GROUPING

(75) Inventor: Donald E. Weder, Highland, IL (US)

(73) Assignee: Wanda M. Weder and William F. Straeter, Highland, IL (US), not individually but solely as Trustees of The Family Trust U/T/A dated 12/08/1995

( * ) Notice: Subject to any disclaimer, the term of this patent is extended or adjusted under 35 U.S.C. 154(b) by 0 days.

(21) Appl. No.: 13/100,782

(22) Filed: May 4, 2011

(65) Prior Publication Data

US 2011/0203173 A1 Aug. 25, 2011

Related U.S. Application Data

(63) Continuation of application No. 12/290,304, filed on Oct. 29, 2008, now abandoned, which is a continuation-in-part of application No. 11/490,353, filed on Jul. 20, 2006, now abandoned.

(51) Int. Cl.
*A47G 7/00* (2006.01)

(52) U.S. Cl. ..... 47/41.01; 47/72

(58) Field of Classification Search ..... 47/72; 206/423
See application file for complete search history.

(56) References Cited

U.S. PATENT DOCUMENTS

| | | | |
|---|---|---|---|
| 732,889 | A | 7/1903 | Paver |
| 797,175 | A | 8/1905 | Collenburg et al. |
| 1,206,708 | A | 11/1916 | Hutchins |
| 1,446,563 | A | 2/1923 | Hughes |
| 1,490,026 | A | 4/1924 | Richards |
| 1,610,652 | A | 12/1926 | Bouchard |
| 1,697,751 | A | 1/1929 | Blake |
| 1,704,801 | A | 3/1929 | Miller |
| 1,964,887 | A | 7/1934 | Lovett, Jr. |
| 1,988,886 | A | 1/1935 | Wilson |
| 1,994,962 | A | 3/1935 | Rushfeldt |
| 2,023,782 | A | 12/1935 | Driver |
| 2,062,410 | A | 12/1936 | Garcia |
| 2,152,648 | A | 4/1939 | Jones |
| 2,158,688 | A | 5/1939 | Brooks |
| 2,200,111 | A | 5/1940 | Bensel |
| 2,209,778 | A | 7/1940 | Krasowski |
| 2,218,293 | A | 10/1940 | Muller |
| 2,274,526 | A | 2/1942 | Bunn |

(Continued)

FOREIGN PATENT DOCUMENTS

AU 4231978 6/1979

(Continued)

OTHER PUBLICATIONS

Chantler & Chantler brochure showing Zipper Sleeve™ and Florasheet®, Date unknown, 2 pages.

(Continued)

*Primary Examiner* — Frank T Palo
(74) *Attorney, Agent, or Firm* — Dunlap Codding, P.C.

(57) ABSTRACT

A method for wrapping a floral grouping is disclosed. In the method a substantially shape-sustaining sheet of material having a substantially circular shape is formed into a substantially frusto-conical shaped bouquet holder with an open upper end that has a diameter greater than the diameter of a lower end thereof. A floral grouping may be disposed within the bouquet holder, and the bouquet holder may be further provided with a skirt.

28 Claims, 9 Drawing Sheets

U.S. PATENT DOCUMENTS 2,278,673 A 4/1942 Savada et al.
2,302,259 A 11/1942 Rothfuss
2,323,287 A 7/1943 Amberg
2,510,438 A 7/1950 Doolittle
2,529,060 A 11/1950 Trillich
2,540,707 A 2/1951 Beukelman
2,774,187 A 12/1956 Smithers
2,846,060 A 8/1958 Yount
2,850,842 A 9/1958 Eubank, Jr.
2,989,828 A 6/1961 Warp
3,022,605 A 2/1962 Reynolds
3,073,062 A 1/1963 Hoffman
3,271,922 A 9/1966 Wallerstein et al.
3,316,675 A 5/1967 Cartwright, Jr.
3,376,666 A 4/1968 Leonard
3,380,646 A 4/1968 Doyen et al.
3,431,706 A 3/1969 Stuck
3,508,372 A 4/1970 Wallerstein et al.
3,512,700 A 5/1970 Evans et al.
3,531,910 A 10/1970 Snead
3,552,059 A 1/1971 Moore
3,554,434 A 1/1971 Anderson
3,556,389 A 1/1971 Gregoire
3,748,781 A 7/1973 Erling
3,767,104 A 10/1973 Bachman et al.
3,869,828 A 3/1975 Matsumoto
3,924,795 A * 12/1975 Smith ..... 229/4.5
3,962,503 A 6/1976 Crawford
4,006,561 A 2/1977 Thoma et al.
4,091,925 A 5/1978 Griffo et al.
4,109,442 A 8/1978 Maasbach
4,118,890 A 10/1978 Shore
4,189,868 A 2/1980 Tymchuck et al.
4,216,620 A 8/1980 Weder et al.
4,280,314 A 7/1981 Stuck
4,297,811 A 11/1981 Weder
4,300,312 A 11/1981 Weder et al.
4,333,267 A 6/1982 Witte
4,347,686 A 9/1982 Wood
4,400,910 A 8/1983 Koudstaal et al.
4,413,725 A 11/1983 Bruno et al.
4,621,733 A 11/1986 Harris
4,646,470 A 3/1987 Maggio
4,733,521 A 3/1988 Weder et al.
4,773,182 A 9/1988 Weder et al.
4,801,014 A 1/1989 Meadows
4,835,834 A 6/1989 Weder
D301,991 S 7/1989 Van Sant
4,885,898 A 12/1989 Khurgin
4,910,913 A 3/1990 Streeter
4,941,572 A 7/1990 Harris
5,073,161 A 12/1991 Weder et al.
5,074,675 A 12/1991 Osgood
5,077,937 A 1/1992 Weder et al.
5,085,003 A 2/1992 Garcia
5,105,599 A 4/1992 Weder
5,106,662 A 4/1992 Khayat
5,111,638 A 5/1992 Weder
5,120,382 A 6/1992 Weder
5,152,100 A 10/1992 Weder et al.
5,181,364 A 1/1993 Weder
5,199,242 A 4/1993 Weder et al.
5,205,108 A 4/1993 Weder et al.
5,228,234 A 7/1993 de Klerk et al.
5,231,794 A 8/1993 Weder et al.
5,235,782 A 8/1993 Landau
5,239,775 A 8/1993 Landau
5,249,407 A 10/1993 Stuck
5,259,106 A 11/1993 Weder et al.
5,307,605 A 5/1994 Straeter
5,307,606 A 5/1994 Weder
5,332,610 A 7/1994 Weder et al.
5,335,475 A 8/1994 Weder et al.
5,335,476 A 8/1994 Weder
5,335,477 A 8/1994 Weder
5,339,601 A 8/1994 Weder
5,353,575 A 10/1994 Stepanek
5,361,482 A 11/1994 Weder et al.
5,388,695 A 2/1995 Gilbert
D356,029 S 3/1995 Weder et al.
5,410,856 A 5/1995 Weder et al.
5,443,670 A 8/1995 Landau
D364,340 S * 11/1995 Weder et al. ..... D9/712
5,473,858 A 12/1995 Hayes
5,493,809 A 2/1996 Weder et al.
D368,025 S 3/1996 Sekerak et al.
5,496,251 A 3/1996 Cheng
5,496,252 A 3/1996 Gilbert
5,501,059 A 3/1996 Weder et al.
5,509,188 A 4/1996 Weder et al.
5,522,202 A 6/1996 Weder et al.
5,526,932 A 6/1996 Weder
5,560,488 A 10/1996 Weder
5,572,851 A 11/1996 Weder
5,575,133 A 11/1996 Weder et al.
5,595,045 A 1/1997 Weder et al.
5,595,298 A 1/1997 Straeter
5,595,802 A 1/1997 Weder et al.
5,615,532 A 4/1997 Weder et al.
5,617,703 A 4/1997 Weder
5,623,807 A 4/1997 Weder et al.
5,624,320 A 4/1997 Martinez
5,636,502 A 6/1997 Straeter et al.
5,647,168 A 7/1997 Gilbert
5,647,189 A 7/1997 Weder et al.
5,664,403 A 9/1997 Weder et al.
5,758,772 A 6/1998 Weder et al.
D401,139 S 11/1998 Weder et al.
5,890,343 A 4/1999 Weder et al.
5,890,592 A 4/1999 Weder et al.
5,930,981 A 8/1999 Weder et al.
5,937,576 A 8/1999 Weder et al.
6,082,045 A 7/2000 Weder et al.
6,101,789 A 8/2000 Weder et al.
6,105,771 A 8/2000 Weder et al.
6,123,194 A 9/2000 Weder et al.
6,269,611 B1 8/2001 Weder et al.
6,345,488 B2 2/2002 Weder et al.
6,427,380 B2 8/2002 Weder et al.
6,453,612 B2 * 9/2002 Weder et al. ..... 47/72
6,513,304 B2 2/2003 Weder et al.
6,543,184 B2 4/2003 Weder et al.
6,588,148 B2 7/2003 Weder et al.
6,601,343 B2 8/2003 Weder et al.
6,655,085 B2 12/2003 Weder et al.
6,662,498 B2 12/2003 Weder
6,672,005 B2 1/2004 Weder et al.
6,672,006 B2 1/2004 Weder et al.
6,691,459 B2 2/2004 Weder et al.
6,711,852 B2 3/2004 Weder et al.
6,725,600 B2 4/2004 Weder et al.
6,868,636 B2 3/2005 Weder et al.
6,904,716 B2 6/2005 Weder et al.
7,073,290 B2 7/2006 Weder et al.
2001/0039756 A1 11/2001 Weder et al.
2008/0134573 A1 6/2008 Flaster
2009/0229178 A1 9/2009 Weder

FOREIGN PATENT DOCUMENTS

BE 654427 5/1982
CH 560532 4/1975
CN 560532 4/1975
DE 345464 12/1921
DE 513971 11/1930
DE 1166692 5/1962
DE 1962947 6/1971
DE 2060812 11/1971
DE 2748626 5/1979
DE 2948265 11/1979
DE 3445799 6/1986
DE 3829281 5/1989
DE 8905250 10/1989
DE 3911847 10/1990
DE 299524 4/1992
EP 0050990 5/1982
EP 0163453 12/1985
EP 0791543 8/1997

| | | |
|---|---|---|
| FR | 1084888 | 1/1955 |
| FR | 1376047 | 9/1964 |
| FR | 1393725 | 2/1965 |
| FR | 2036163 | 12/1970 |
| FR | 2137325 | 12/1972 |
| FR | 2272914 | 12/1975 |
| FR | 2489126 | 3/1982 |
| FR | 2603159 | 3/1988 |
| FR | 2610604 | 8/1988 |
| FR | 2619698 | 3/1989 |
| FR | 2651663 | 3/1991 |
| FR | 2734464 | 5/1995 |
| GB | 15550 | 0/1899 |
| GB | 28322 | 0/1907 |
| GB | 1204647 | 9/1970 |
| GB | 2056410 | 3/1981 |
| GB | 2074542 | 11/1981 |
| GB | 2128083 | 4/1984 |
| GB | 2252708 | 8/1992 |
| IT | 224507 | 4/1996 |
| JP | 4158036 | 6/1992 |
| JP | 542958 | 2/1993 |
| NL | 8301709 | 12/1984 |
| NL | 1000658 | 3/1996 |
| WO | WO9009924 | 9/1990 |
| WO | WO9315979 | 8/1993 |
| WO | WO9637133 | 11/1996 |
| WO | WO 01/28890 A1 | 10/2000 |
| WO | WO 2004/074135 A1 | 9/2004 |

OTHER PUBLICATIONS

"Cellocoup—It's a Wrap", The John Henry Company, 1992, 4 pages.
"Color Them Happy with Highlander Products" © 1992.
"Super Seller", Supermarket Floral, Sep. 15, 1992.
"Costa Keeps the Christmas Spirit", Supermarket Floral, Sep. 15, 1992.
"Derwent Abstract" of FR 2610604A. 1988.
"Now More Than Ever", Supermarket Floral, Sep. 15, 1992.
"Halloween", Link Magazine, Sep. 1992, 2 pages.
"Target Halloween Sales With Highlander", Brochure, Highland Supply Corporation, 1992.
"Speed Sheets and Speed Rolls" Brochure, Highland Supply Corporation, © 1990.
Le Plant Sac Advertisement, published prior to Sep. 26, 1987.
"A World of Cut Flower and Pot Plant Packaging" Brochure, Klerk's Plastic Products Manufacturing, Inc., Date unknown, 6 pages.
D-Bros Vinyl Vase; Item# 804F-ST, 804F-SP, 2 vases in different colors, Feb. 2004.

* cited by examiner

METHOD OF WRAPPING A FLORAL GROUPING

CROSS REFERENCE TO RELATED APPLICATIONS

This application is a continuation of U.S. Ser. No. 12/290,304, filed Oct. 29, 2008, now abandoned; which is a continuation-in-part of U.S. Ser. No. 11/490,353, filed Jul. 20, 2006, now abandoned. The entire contents of the above-referenced patents and patent application are hereby expressly incorporated herein by reference.

FIELD OF INVENTION

The present invention relates generally to a method for wrapping a floral grouping, and more particularly but not by way of limitation, to a method for wrapping a floral grouping with a bouquet holder.

DETAILED DESCRIPTION OF THE INVENTION

Figure 1:
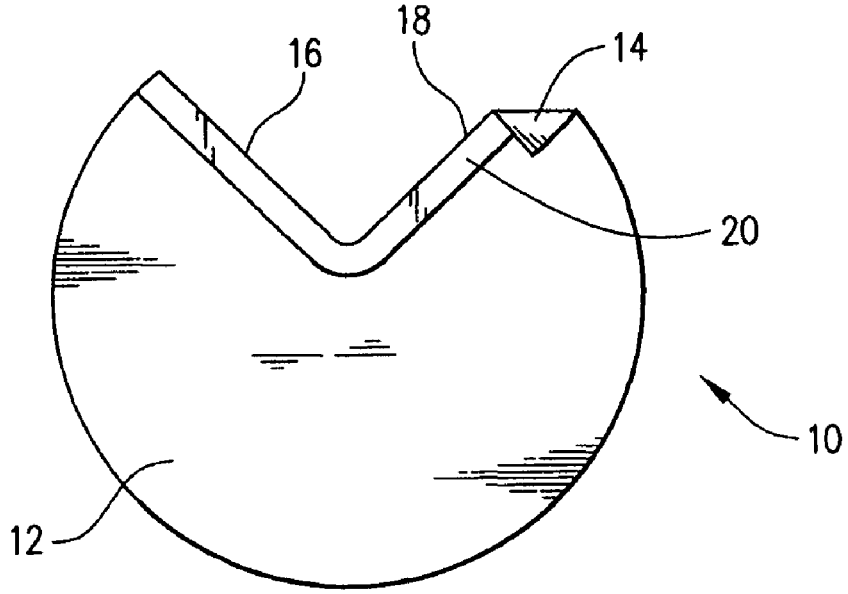
FIG. 1 is a pictorial representation of a substantially shape-sustaining sheet of material used for wrapping a floral grouping in accordance with the present invention.

Before explaining at least one embodiment of the invention in detail, it is to be understood that the invention is not limited in its application to the details of construction and the arrangement of the components or steps or methodologies set forth in the following description or illustrated in the drawings. The invention is capable of other embodiments or of being practiced or carried out in various ways. Also, it is to be understood that the phraseology and terminology employed herein is for the purpose of description and should not be regarded as limiting.

The present invention relates generally to a method for wrapping a floral grouping which includes the steps of providing a substantially shape-sustaining sheet of material having a substantially arcuate shape. The substantially shape-sustaining sheet of material has an upper surface, a lower surface, a first end portion, a second end portion and a connecting element which connects the first end portion of the substantially shape-sustaining sheet of material to the second end portion of the substantially shape-sustaining sheet of material.

The substantially shape-sustaining sheet of material is formed into a substantially frusto-conical shaped bouquet holder by connecting the first end portion of the substantially shape-sustaining sheet of material to the second end portion of the substantially shape-sustaining sheet of material. The bouquet holder so formed has an outer peripheral surface, an inner peripheral surface defining an internal chamber, an open upper end and a lower end. The open upper end of the bouquet holder has a diameter greater than the diameter of the lower end thereof.

The method further includes providing a floral grouping and disposing a portion of the floral grouping into the internal chamber of the bouquet holder through the open upper end of the bouquet holder. The substantially shape sustaining sheet of material may be formed into the bouquet holder prior to disposing the floral grouping therein, or the substantially shape sustaining sheet of material may be formed about the floral grouping to provide the bouquet holder.

Referring now to the drawings, and more particularly to FIG. 1, shown therein is a pictorial representation of a substantially shape-sustaining sheet of material 10 having a substantially arcuate shape. The substantially shape-sustaining sheet of material 10 is shown with an upper surface 12, a lower surface 14, a first end portion 16, a second end portion 18 and a connecting element 20 which connects the first end portion 16 of the substantially shape-sustaining sheet of material 10 to the second end portion 18 of the substantially shape-sustaining sheet of material 10.

Figure 3:
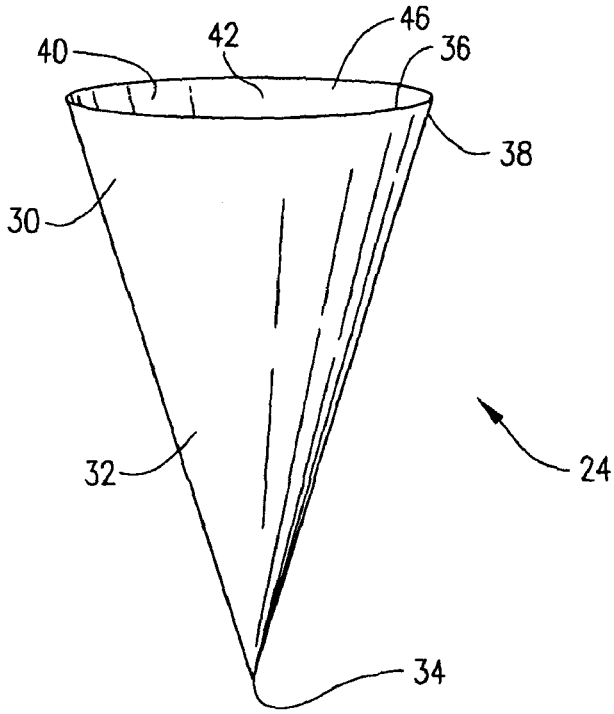
FIG. 3 is a pictorial representation of a bouquet holder formed from the substantially shape-sustaining sheet of material of FIG. 1.
Figure 4:
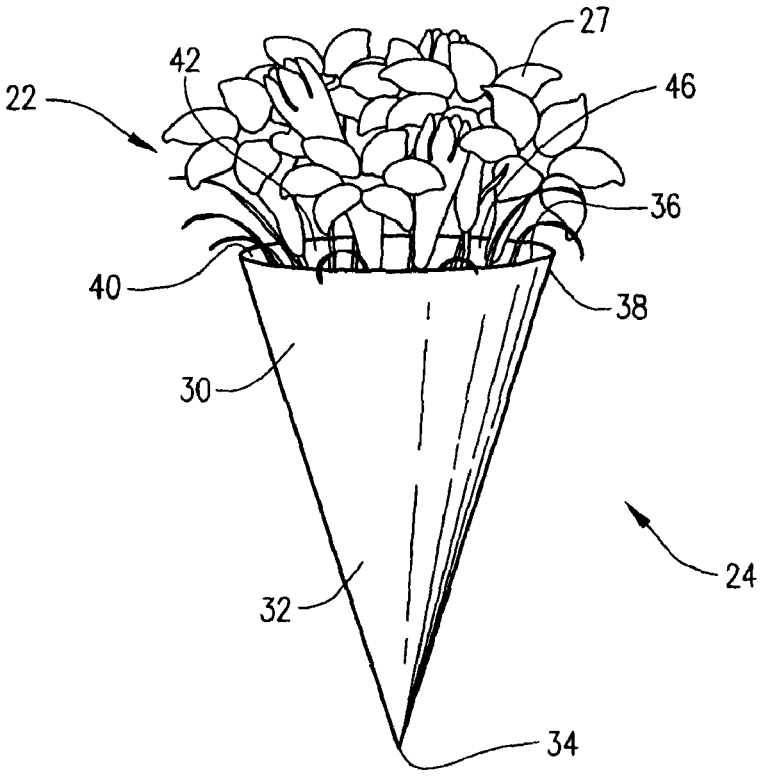
FIG. 4 is a pictorial representation of a floral grouping disposed within the bouquet holder of FIG. 3.
Figure 10:
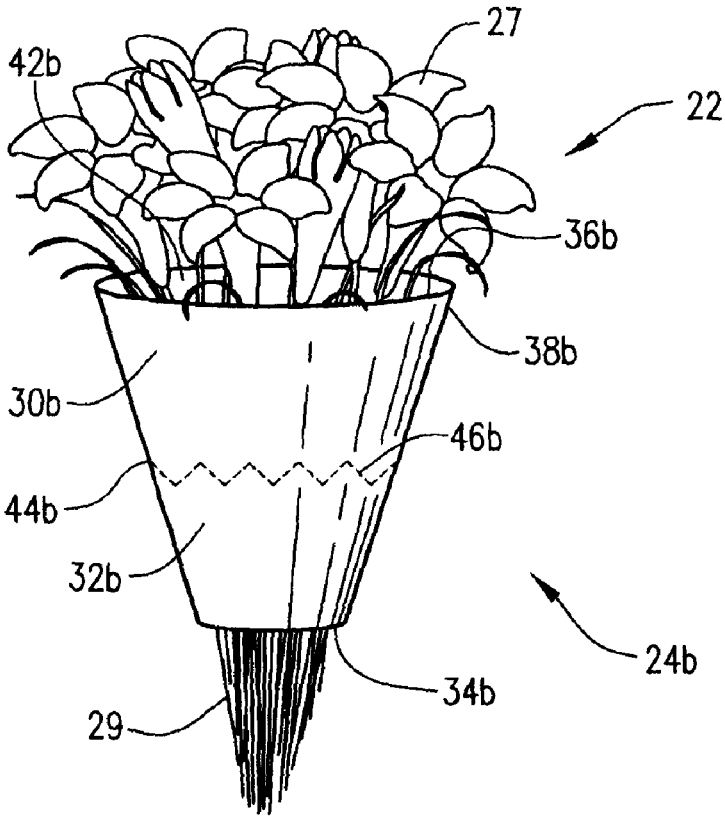
FIG. 10 is a pictorial representation of a floral grouping disposed within the bouquet holder of FIG. 9.

The substantially shape-sustaining sheet of material 10 is sized so that the substantially shape-sustaining sheet of material 10 can be formed about a floral grouping 22, to form a bouquet holder 24, as shown in FIGS. 3-4. The floral grouping 22 is illustrated as having a bloom portion 27 and a stem portion 29, as shown in FIG. 10. However, the term "floral grouping" as used herein will be understood to not be limited to requiring bloom and stem portions. Further, the term "floral grouping" as used herein will be understood to include a single flower having a bloom end and a stem end, a plurality of flowers at least a portion of which have a bloom end and a stem end, foliage, botanical items, propagules, cut flowers, artificial flowers and/or other fresh and/or artificial plants or floral materials; including secondary plants and/or other ornamentation which adds to the synthetic qualities of the overall appearance of the floral grouping.

The substantially shape-sustaining sheet of material 10 is sized so that the stem portion 29 of the floral grouping 22 can be disposed into the bouquet holder 24, when the substantially shape-sustaining sheet of material 10 is formed into the bouquet holder 24, and sized so that the substantially shape-sustaining sheet of material 10 can also be formed about the floral grouping 22 to form the bouquet holder 24. In addition, at least a portion of the bloom portion 27 of the floral grouping 22 may extend beyond an upper end 36 of the bouquet holder 24.

The substantially shape-sustaining sheet of material 10 used to form the bouquet holder 24 can be fabricated of any material having sufficient flexibility and structural integrity to enable one to form the substantially shape-sustaining sheet of material 10 about the floral grouping 22 into the bouquet holder 24 and in the alternative to form the substantially shape sustaining sheet of material 10 into the bouquet holder 24 and then dispose the floral grouping 22 into the bouquet holder 24.

It should be understood that the thickness of the substantially shape-sustaining sheet of material 10 may vary depending on the type of material from which the substantially shape-sustaining sheet of material 10 is constructed, the only requirement being that the substantially shape-sustaining sheet of material 10 be capable of being wrapped or formed about the floral grouping 22 to form the bouquet holder 24. For example but not by way of limitation, the substantially shape-sustaining sheet of material 10 employed in the construction of the bouquet holder 24 may have a thickness from about 0.1 mil to about 100 mil.

That is, it should be understood that the substantially shape-sustaining sheet of material 10 can be constructed of any desired material as long as the substantially shape-sustaining sheet of material 10 retains sufficient flexibility, foldability and structural integrity so that the substantially shape-sustaining sheet of material 10 can be formed about the floral grouping 22 to form the bouquet holder 24. For example, the substantially shape-sustaining sheet of material 10 can be constructed of paper (untreated and treated in any manner), metal, foil, polymeric film, fabric (woven, non-woven, synthetic or natural), cardboard, fiber, cloth, burlap or laminations and combinations thereof. The term "polymeric film" as used herein refers to a film formed of synthetic polymers, such as polypropylene or naturally occurring polymers such as cellophane, which are relatively strong and not subject to tearing (substantially non-tearable). Various types of "polymeric films" are described in U.S. Pat. No. 5,311,991, issued to Weder et al. on May 17, 1994, the contents of which are hereby expressly incorporated herein by reference.

If desired, a decorative pattern, such as a color and/or an embossed pattern and/or a hologram and/or other decorative surface ornamentation may be applied to at least a portion of the upper and/or lower surfaces 12 and 14 of the substantially shape-sustaining sheet of material 10, including but not limited to, printed designs, embossed designs, coatings, colors, flocking, metallic finishes, combinations thereof and the like. Further, the substantially shape-sustaining sheet of material 10 may be totally clear or partially clear or a tinted transparent material.

Figure 2:
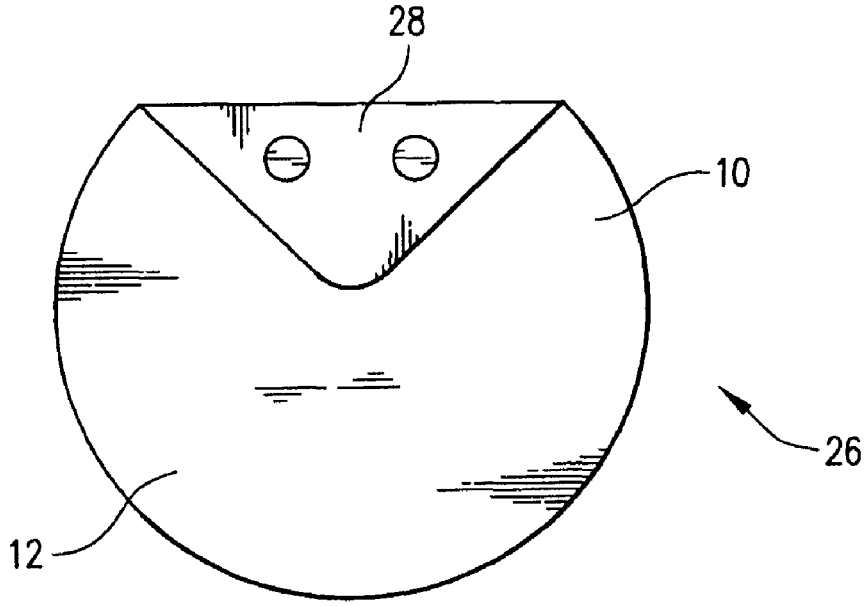
FIG. 2 is a pictorial representation of a pad of substantially shape-sustaining sheets of material.

Referring now to FIG. 2, shown therein is a pictorial representation of a pad 26 of substantially shape-sustaining sheets of material 10. The pad 26 of substantially shape-sustaining sheets of material 10 is shown with an assembly tab 28 which detachably connects at least one sheet of substantially shape-sustaining sheets of material 10 to at least one other sheet of substantially shape-sustaining sheets of material 10, such that at least one substantially shape-sustaining sheet of material 10 can be selectively connected to and selectively separated from the pad 26 of substantially shape-sustaining sheets of material 10. The term "assembly tab" refers to a single element or a combination of elements such as tear tabs, headers, tear lines, pull tabs, adhesive and the like.

Referring now to FIGS. 3-4 shown therein are pictorial representations of the frusto-conical shaped bouquet holder 24. Specifically, FIG. 3 depicts the bouquet holder 24 formed from the substantially shape-sustaining sheet of material 10 and FIG. 4 depicts the bouquet holder 24 formed from the substantially shape-sustaining sheet of material 10, having the floral grouping 22 disposed therein. The bouquet holder 24 is shown with an upper portion 30, a lower portion 32, a lower end 34 and an open upper end 36. The open upper end 36 has a diameter greater than the diameter of the lower end 34. The bouquet holder 24 also has an outer peripheral surface 38, and an inner peripheral surface 40 defining an internal chamber 42. The lower end 34 of the bouquet holder 24 is closed such that the internal chamber 42 of the bouquet holder 24 defines a reservoir 46 for confining a liquid.

The bouquet holder 24 can be formed by connecting the first end portion 16 of the substantially shape-sustaining sheet of material 10 to the second end portion 18 of the substantially shape-sustaining sheet of material 10, and the floral grouping 22 disposed therein after the bouquet holder 24 is formed. Optionally, the bouquet holder 24 can be formed by forming the substantially shape-sustaining sheet of material 10 about the floral grouping 22 and connecting the first end portion 16 of the substantially shape sustaining sheet of material 10 to the second end portion 18 of the substantially shape-sustaining sheet of material 10.

While the bouquet holder 24 has been described as being formed of a single sheet of substantially shape-sustaining material 10, it should be understood that the bouquet holder 24 can be formed of two or more sheets of substantially shape-sustaining sheets of material 10. When employing two or more sheets of substantially shape-sustaining material 10 to form the bouquet holder 24 about the floral grouping 22, the configuration of each sheet of substantially shape-sustaining sheets of material 10 may vary depending on the overall design desired. In addition, the two or more sheets of substantially shape sustaining material 10 may be unconnected to one another or may be connected or laminated together by any methods known in the art.

Figure 5:
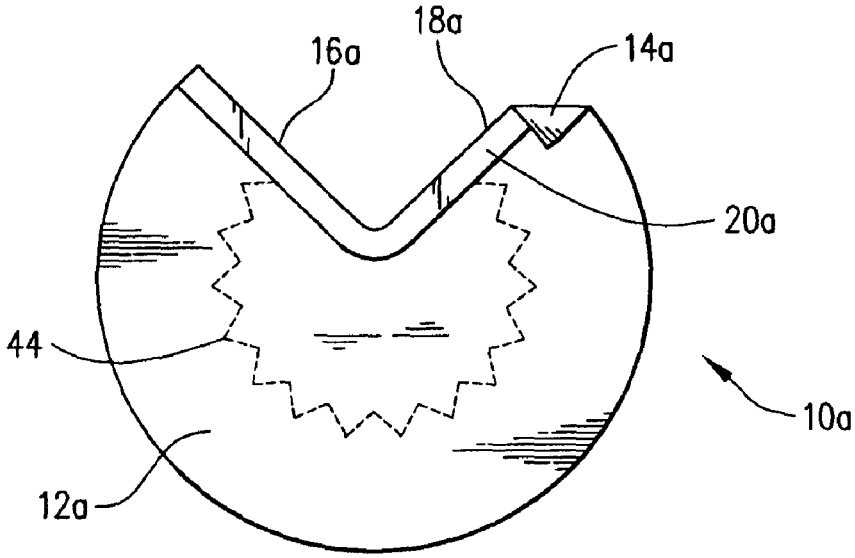
FIG. 5 is a pictorial representation of a substantially shape-sustaining sheet of material used for wrapping a floral grouping in accordance with the present invention.

Referring now to FIG. 5, shown therein is a pictorial representation of a substantially shape sustaining sheet of material **10*a*. The substantially shape-sustaining sheet of material 10*a* is similar in function and use to the substantially shape-sustaining sheet of material 10 described above. Therefore, for purposes of brevity, only the features of the substantially shape-sustaining sheet of material 10*a* which differ from the features of the substantially shape-sustaining sheet of material 10 will be described below. Further, the features of the substantially shape-sustaining sheet of material 10*a* which are identical to the features of the substantially shape-sustaining sheet of material 10** will be identified by the same reference numbers used above followed by the letter "a".

The substantially shape-sustaining sheet of material 10*a* is shown with an upper surface 12*a*, a lower surface 14*a*, a first end portion 16*a*, a second end portion 18*a* and a connecting element 20*a* which connects the first end portion 16*a* of the substantially shape-sustaining sheet of material 10*a* to the second end portion 18*a* of the substantially shape-sustaining sheet of material 10*a*. In addition, the substantially shape-sustaining sheet of material 10*a* is shown with a detaching element 44. The term "detaching element" as used herein means any element, or combination of elements, which enable the tearing away or detachment of one object or portion of an object from another object or portion of an object.

Figure 6:
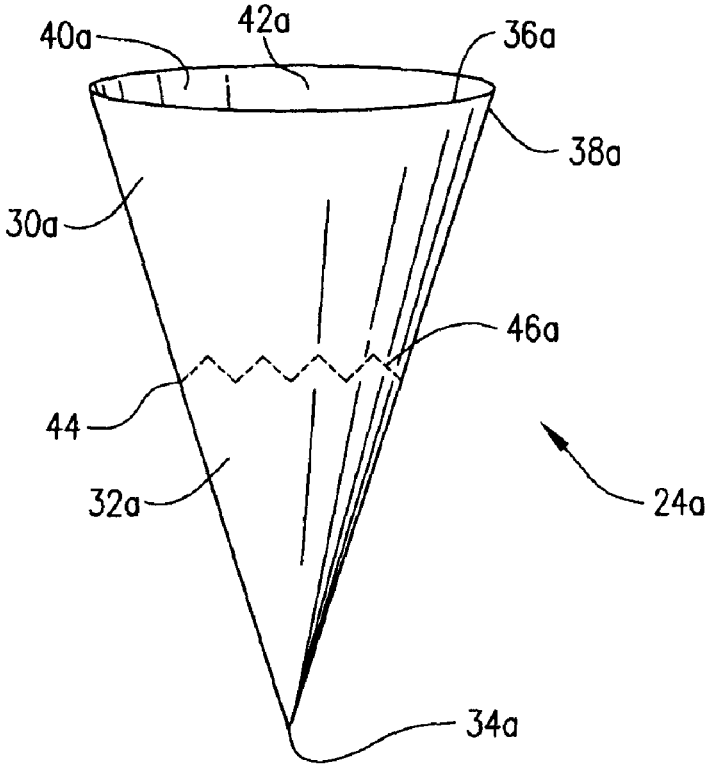
FIG. 6 is a pictorial representation of a bouquet holder formed from the substantially shape-sustaining sheet of material of FIG. 5.
Figure 7:
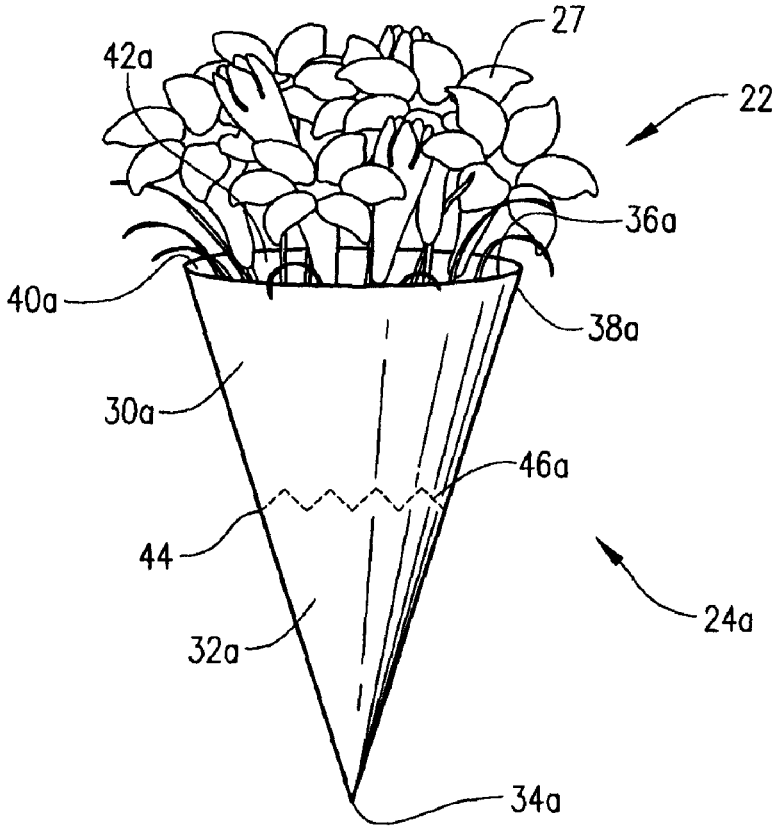
FIG. 7 is a pictorial representation of a floral grouping disposed within the bouquet holder of FIG. 6.

Referring now to FIGS. 6-7, shown therein are pictorial representations of a bouquet holder 24*a* formed from the substantially shape-sustaining sheet of material 10*a*. Specifically, FIG. 6 depicts the bouquet holder 24*a* without the floral grouping 22 and FIG. 7 depicts the bouquet holder 24*a* with the floral grouping 22 disposed therein. The bouquet holder 24*a* is similar in function and use to the bouquet holder 24 described above except that the bouquet holder 24*a* is provided with the detaching element 44. For purposes of brevity, the features of the bouquet holder 24*a* which are identical to the features of the bouquet holder 24, and which were previously described, will not be described again and will be identified by the same reference numbers used for the bouquet holder 24 followed by the letter "a".

The bouquet holder 24*a* is demarcated into a lower portion 32*a* and an upper portion 30*a* by the detaching element 44. The detaching element 44 permits the detachable upper portion 30*a* of the bouquet holder 24*a* to be removed from the lower portion 32*a* of the bouquet holder 24*a*. Examples of such detaching elements include, but are not limited to, perforations, tear strips, zippers, adhesive and any other devices or elements known in the art, or any combination thereof, which enables the detachment of the detachable upper portion 30*a* of the bouquet holder 24*a* from the lower portion 32*a* of the bouquet holder 24*a*.

The detaching element 44 enables detachment of the upper portion 30*a* of the bouquet holder 24*a* from the lower portion 32*a* of the bouquet holder 24*a* such that the bouquet holder 24*a* has an upper edge 46. The detaching element 44 may have a non-linear pattern or shape and/or a linear pattern or shape, such that upon detaching the upper portion 30*a* of the bouquet holder 24*a* from the lower portion 32*a* of the bouquet holder 24*a* the upper edge 46 of the bouquet holder 24*a* may have a non-linear pattern or shape and/or a linear pattern or shape.

Figure 8:
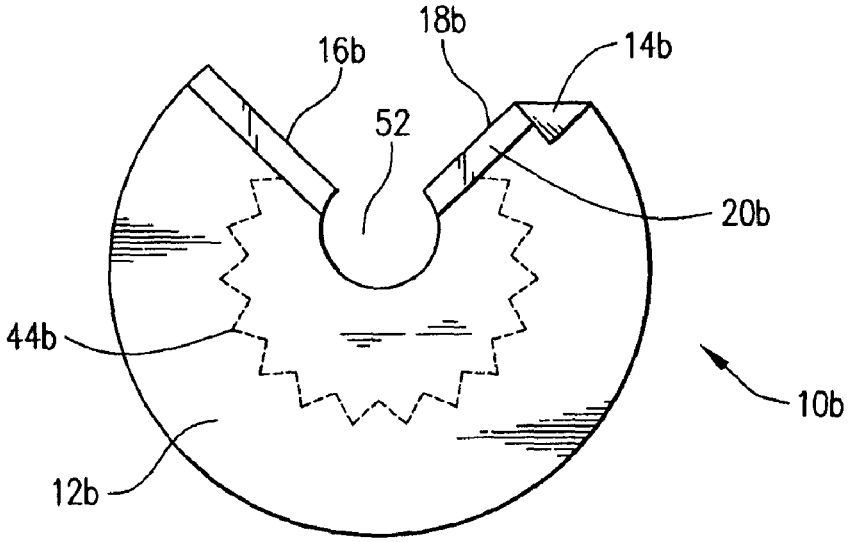
FIG. 8 is a pictorial representation of a substantially shape-sustaining sheet of material constructed in accordance with the present invention, the substantially shape sustaining sheet of material having an opening extending therethrough.

Referring now to FIG. 8, shown therein is a pictorial representation of a substantially shape-sustaining sheet of material 10*b*. The substantially shape-sustaining sheet of material 10*b* is similar in function and use to the substantially shape-sustaining sheets of material 10 and 10*a* described above. Therefore, for purposes of brevity, only the features of the substantially shape-sustaining sheet of material 10*b* which differ from the features of the substantially shape-sustaining sheets of material 10 and 10*a* will be described below. Further, the features of the substantially shape-sustaining sheet of material 10*b* which are identical to the features of the substantially shape-sustaining sheets of material 10 and 10*a* will be identified by the same reference numbers used above followed by the letter "b".

The substantially shape-sustaining sheet of material 10*b* is shown with an upper surface 12*b*, a lower surface 14*b*, a first end portion 16*b*, a second end portion 18*b* and a connecting element 20*b* which connects the first end portion 16*b* of the substantially shape-sustaining sheet of material 10*b* to the second end portion 18*b* of the substantially shape-sustaining sheet of material 10*b*. In addition, the substantially shape-sustaining sheet of material 10*b* is provided with a recess 52 extending therethrough. The recess 52 is provided, so that when the substantially shape-sustaining sheet of material 10*b* is formed into a bouquet holder 24*b* substantially as shown in FIGS. 9-10, the bouquet holder 24*b* has an open lower end 34*b* such that the stem portion 29 of the floral grouping 22 can be at least partially disposed therethrough.

Figure 9:
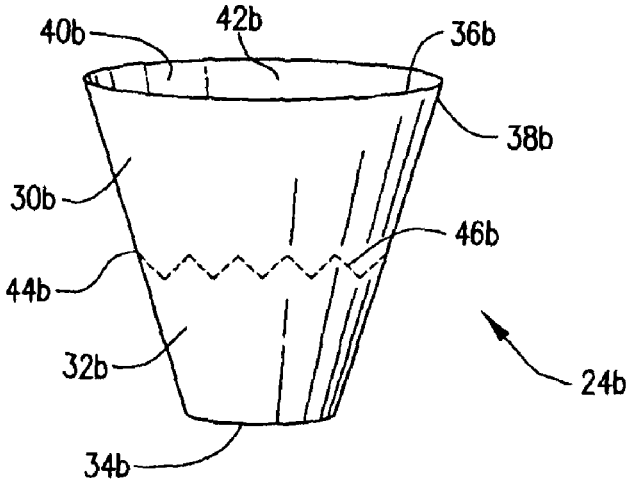
FIG. 9 is a pictorial representation of a bouquet holder formed from the substantially shape-sustaining sheet of material of FIG. 8.

Referring now to FIGS. 9-10, shown therein are pictorial representations of a bouquet holder 24*b* formed from the substantially shape-sustaining sheet of material 10*b*. For purposes of brevity, the features of the bouquet holder 24*b* which are identical to the features of the bouquet holders 24 and 24*a*, and which were previously described, will not be described again and will be identified by the same reference numbers used for the bouquet holders 24 and 24*a* followed by the letter "b".

FIG. 9 depicts the bouquet holder 24*b* without the floral grouping 22 and FIG. 10 depicts the bouquet holder 24*b* with the floral grouping 22 disposed therein. The bouquet holder 24*b* is similar in function and use to the bouquet holder 24 and 24*a* described above except that the bouquet holder 24*b* is provided with an open lower end 34*b* such that a portion of the stem portion 29 of the floral grouping 22 can extend through the open lower end 34*b* of the bouquet holder 24*b*.

Figure 11:
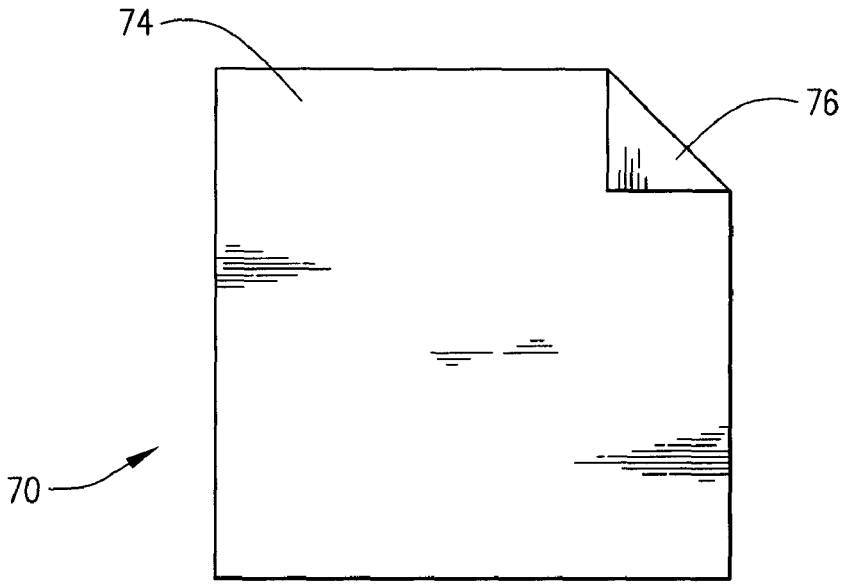
FIG. 11 is a pictorial representation of a flexible sheet of material which can be formed into a skirt for a bouquet holder constructed in accordance with the present invention.
Figure 12:
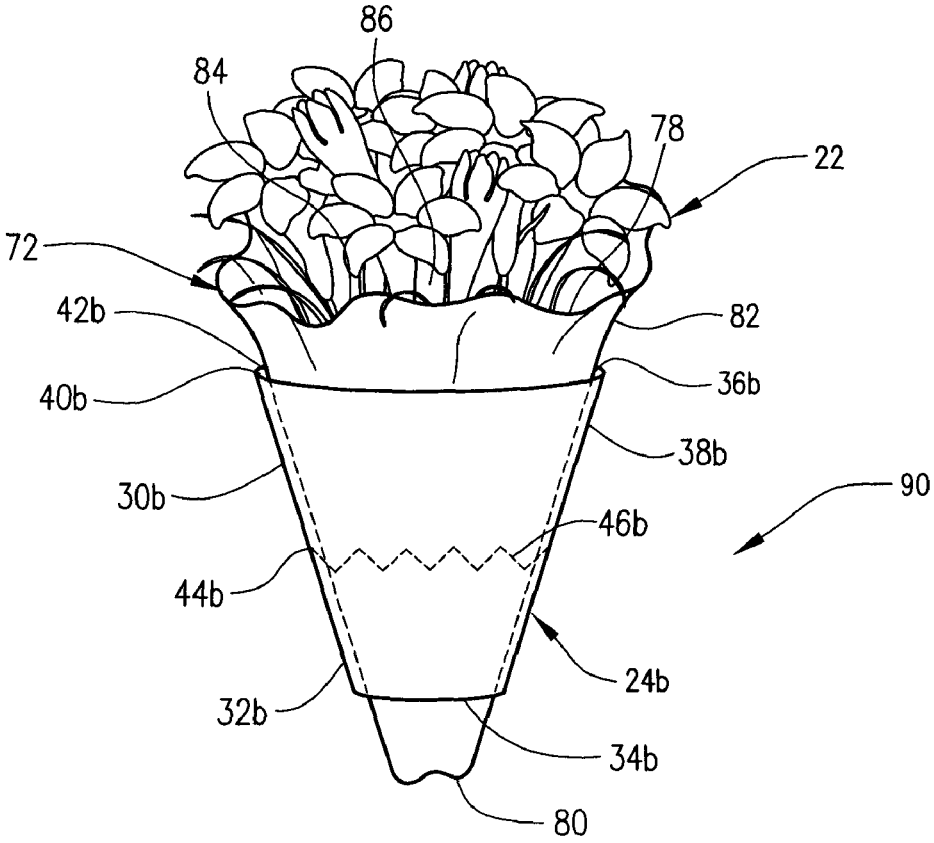
FIG. 12 is a pictorial representation of a decorative assembly, which includes a skirt formed from the flexible sheet of material of FIG. 11 disposed about a bouquet holder constructed in accordance with the present invention.

Referring now to FIG. 11 shown therein is a flexible sheet of material 70 which can be used to form a skirt 72 (substantially as shown in FIG. 12) for a bouquet holder, such as but not limited to the bouquet holder 24, 24*a* or 24*b*. The flexible sheet of material 70 is shown with an upper surface 74 and a lower surface 76.

The flexible sheet of material 70 is sized so that the flexible sheet of material 70 can be disposed about a bouquet holder, such as but not limited to the bouquet holder 24, 24*a* and 24*b*. The flexible sheet of material 70 will desirably have a thickness from about 0.1 mil to about 30 mil., and more desirably from about 1 mil to about 10 mil. However, it should be understood that the thickness of the flexible sheet of material 70 may vary depending on the type of material from which the flexible sheet of material 70 is constructed, the only requirement being that the flexible sheet of material 70 be capable of being disposed about a bouquet holder, such as but not limited to bouquet holder 24, 24*a* and 24*b*.

That is, it should be understood that the flexible sheet of material 70 can have any thickness as long as the flexible sheet of material 70 retains sufficient flexibility, foldability and structural integrity so that the flexible sheet of material 70 can be formed about a bouquet holder, such as but not limited to bouquet holder 24, 24*a* and 24*b*. For example, the flexible sheet of material 70 can be constructed of paper (untreated and treated in any manner), metal foil, polymeric film, fabric (woven, non-woven, synthetic or natural), cardboard, fiber, cloth, burlap or laminations and combinations thereof.

If desired, a decorative pattern, such as a color and/or an embossed pattern and/or a hologram and/or other decorative surface ornamentation may be applied to the upper and/or lower surfaces 74 and 76 of the flexible sheet of material 70 or portions thereof, including but not limited to, printed designs, embossed designs, coatings, colors, flocking or metallic finishes. Further, the flexible sheet of material 70 may be totally clear or partially clear or a tinted transparent material.

Referring now to FIG. 12, shown therein is a decorative assembly 90 which includes the bouquet holder 24*b* and a skirt 72. The decorative assembly 90 is shown with the floral grouping 22 disposed therein. While the skirt 72 is shown formed about the bouquet holder 24*b* it should be noted that the skirt 72 can be formed about any bouquet holder including but not limited to the bouquet holder 24, 24*a* and 24*b*.

The skirt 72 is shown disposed about the inner peripheral surface 40*b* of the bouquet holder 24*b*. However, it should be noted that the skirt 72 can also be disposed about the outer peripheral surface 38*b* of the bouquet holder 24*b*. Further, the skirt 72 can be fabricated from any material having sufficient flexibility and structural integrity to enable one to form the skirt 72 about a bouquet holder, such as but not limited to the bouquet holder 24, 24*a* and 24*b*.

Figure 14:
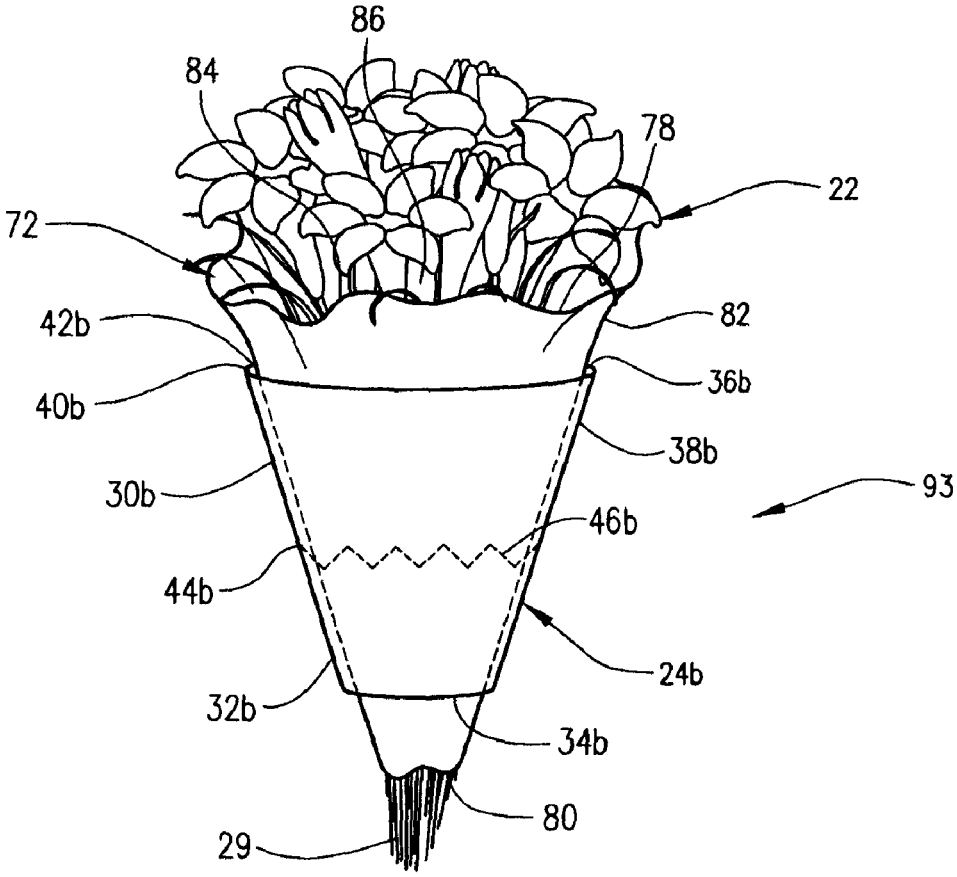
FIG. 14 is a pictorial representation of a decorative assembly which includes a skirt formed from the flexible sheet of material of FIG. 13 disposed about the inner peripheral surface of a bouquet holder constructed in accordance with the present invention.

The skirt 72 has an open upper end 78, a lower end 80, an outer peripheral surface 82 and an inner peripheral surface 84 defining an internal chamber 86. While the lower end 80 of the skirt 72 is shown closed, it should be noted that the lower end 80 of the skirt can also be open (as shown in FIG. 14) such that at least a portion of the stem end of the floral grouping 22 can be disposed therethrough.

The skirt 72 can be disposed about the inner peripheral surface 40*b* of the bouquet holder 24*b*, such that a portion of the skirt 72 is substantially adjacent to the inner peripheral surface 40*b* of the bouquet holder 24*b*. In addition, a portion of the skirt 72 can also be disposed about the outer peripheral surface 38*b* of the bouquet holder 24*b*, such that a portion of the skirt 72 is substantially adjacent to the outer peripheral surface 38*b* of the bouquet holder 24*b*.

The open upper end 78 of the skirt 72 may extend beyond the upper end 36*b* of the bouquet holder 24*b*, or be substantially flush therewith. When the skirt 72 is disposed about the bouquet holder 24, for example, the lower end 80 of the skirt 72 may extend into the bouquet holder 24 and be substantially adjacent to the lower end 34 of the bouquet holder 24. When the floral grouping 22 is disposed in the bouquet holder 24*b*, the stem portion 29 of the floral grouping 22 may be supported by the lower end 80 of the skirt 72 or may extend through the lower end 80 of the skirt 72 and the lower end 34*b* of the bouquet holder 24*b*, as shown in FIG. 14.

Figure 13:
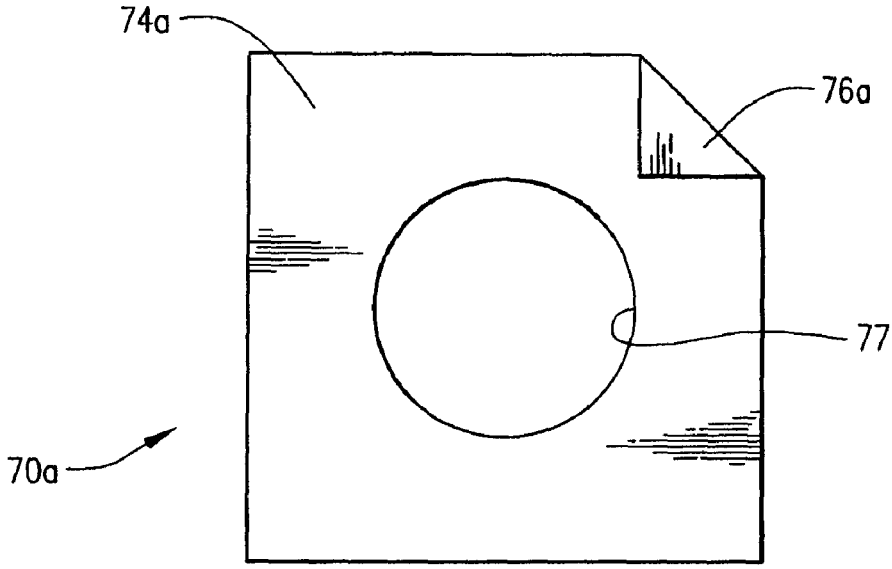
FIG. 13 is a pictorial representation of a flexible sheet of material having an opening extending therethrough which can be formed into a skirt for a bouquet holder constructed in accordance with the present invention.

Referring now to FIG. 13, shown therein is a flexible sheet of material 70*a*. It should be noted that the flexible sheet of material 70*a* is similar in function and use to the flexible sheet of material 70 described above, except as described herein. Therefore, for purposes of brevity, the features of the flexible sheet of material 70*a* which are similar to the features of the flexible sheet of material 70 will not be described again and will be referred to by the same reference numerals followed by the letter "a".

The flexible sheet of material 70*a* is shown with an upper surface 74*a*, a lower surface 76*a* and a substantially centrally located opening 77 extending therethrough. The substantially centrally located opening 77 is positioned such that when the flexible sheet of material 70*a* is formed into the skirt 72, the skirt 72 has an open lower end 80.

Referring now to FIG. 14, shown therein is a decorative assembly 93 that comprises the bouquet holder 24*b* and the skirt 72 formed from the flexible sheet of material 70*a*, wherein the floral grouping 22 is disposed within the decorative assembly 93. While the skirt 72 is shown formed about the bouquet holder 24*b*, it should be noted that the skirt 72 can be formed about any bouquet holder including but not limited to the bouquet holder 24, 24*a* and 24*b*. It should also be noted that the skirt 72 can be fabricated from any material having sufficient flexibility and structural integrity to enable one to form the skirt 72 about a bouquet holder including but not limited to the bouquet holder 24, 24*a* and 24*b*.

The skirt 72 has an open upper end 78, a lower end 80, an outer peripheral surface 82 and an inner peripheral surface 84 defining an internal chamber 86. The lower end 80 of the skirt 72 is open such that at least a portion of the stem end of the floral grouping can be disposed therethrough.

The skirt 72 is shown disposed about the inner peripheral surface 40*b* of the bouquet holder 24*b*. While the skirt 72 is shown disposed about the inner peripheral surface 40*b* of the bouquet holder 24*b*, it should be understood that the skirt 72 can also be disposed about the outer peripheral surface 38*b* of the bouquet holder 24*b*. The skirt 72 is disposed about the inner peripheral surface 40*b* of the bouquet holder 24*b*, such that a portion of the skirt 72 is substantially adjacent to the inner peripheral surface 40*b* of the bouquet holder 24*b*. In addition, a portion of the skirt 72 can also be disposed about the outer peripheral surface 38*b* of the bouquet holder 24*b*, such that a portion of the skirt 72 is substantially adjacent to the outer peripheral surface 38*b* of the bouquet holder 24*b*.

The open upper end 78 of the skirt 72 may extend beyond the upper end 36*b* of the bouquet holder 24*b*, or be substantially flush therewith. When the skirt 72 is disposed about the bouquet holder 24*b*, for example, the lower end 80 of the skirt 72 may extend into the bouquet holder 24*b* and extend beyond the lower end 34*b* of the bouquet holder 24*b*. Alternatively, the lower end 80 of the skirt 72 may be disposed substantially adjacent to the lower end 34*b* of the bouquet holder 24*b*, or may not extend substantially through the internal chamber 42*b* of the bouquet holder 24*b*. When the floral grouping 22 is disposed in the bouquet holder 24*b*, the stem portion 29 of the floral grouping 22 may also extend through the lower end 80 of the skirt 72 and through the lower end 34*b* of the bouquet holder 24*b*.

Figure 15:
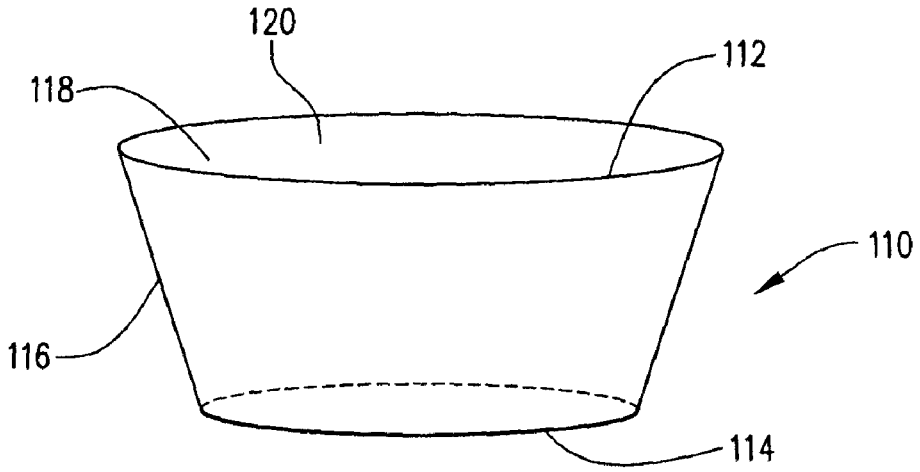
FIG. 15 is a pictorial representation of a skirt formed from a sleeve.

Referring now to FIG. 15, shown therein is a pictorial representation of a skirt 110, formed from a sleeve. For purposes of brevity, and not by way of limitation, only the bouquet holder 24*a* will be described herein with reference to the skirt 110. However, it should be noted that any bouquet holder may be used, including but not limited to the bouquet holder 24, 24*a* or 24*b*.

The skirt 110 is provided with an open upper end 112, an open lower end 114, an outer peripheral surface 116 and an inner peripheral surface 118 defining an internal chamber 120. The skirt 110 may be tapered outwardly from the open lower end 114 towards a larger diameter at the open upper end 112 so as to be substantially frusto-conical when opened. The term "floral sleeve or sleeve" when used herein refers to an initially flexible, flat, collapsed piece of material which is openable to the form of a tube or sleeve.

The skirt 110 can be constructed of any material capable of being formed into the skirt 110 as shown and described herein. In addition, the skirt 110 can be provided with any size or configuration as long as the skirt 110 can be formed into disposed about a bouquet holder, such as bouquet holder 24, 24*a* or 24*b*. For example, the skirt 110 can be fabricated of paper (untreated and treated in any matter), metal foil, polymeric film, fabric (woven, non-woven, synthetic or natural), cardboard, fiber, cloth, burlap, or laminations and combinations thereof. Further, the material from which the skirt 110 can be treated to render such material fluid impermeable by any well known technique, if desired.

Any thickness of material may be utilized in the construction of the skirt 110 as long as the skirt 110 functions in accordance with the present invention as described herein. Desirably, the material from which the skirt 110 is constructed has a thickness in the range from about 0.1 mil to about 30 mil, and more desirably from about 0.5 mil to about 10 mil. The skirt 110 may be constructed of a single layer of material or a plurality of layers of the same or different types of material. When employing layers of material in the construction of the skirt 110, the layers of material may be connected together, laminated or may be employed as separate layers. Such materials used to construct the skirt 110 are described in U.S. Pat. No. 5,111,637 entitled "Method For Wrapping a Flower Grouping", issued to Weder et al., on May 12, 1992, the entire contents of which are especially incorporated herein by reference.

The skirt 110 can be disposed about a bouquet holder, such as but not limited to the bouquet holder 24*a* such that the skirt 110 frictionally engages at least a portion of the bouquet holder to secure the skirt 110 about the bouquet holder. However, the skirt 110 can be connected to a bouquet holder, such as but not limited to the bouquet holder 24*a* by any method which allows the skirt 110 to be disposed about the bouquet holder.

For example, but not by way of limitation, the skirt 110 may be secured about a bouquet holder via bonding material. The term "bonding material" when used herein refers to an adhesive, frequently a pressure sensitive adhesive, or a cohesive. Where the bonding material is a cohesive, a similar cohesive material must be placed on the adjacent surface for bondingly contacting and bondingly engaging with the cohesive material.

The term "bonding material" also includes materials which are heat sealable and, in this instance, the adjacent portions of the material must be brought into contact and then heat must be applied to effect the seal. The term "bonding material" also includes materials which are sonic sealable and vibratory sealable.

The term "bonding material" when used herein also means a heat sealing lacquer or hot melt material which may be applied to the material and, in this instance, heat, sound waves, or vibrations, also must be applied to effect the sealing. The term "bonding material" also includes cold seal adhesives; the cold seal adhesive adheres only to a similar substrate, acting similarly as a cohesive, and binds only to itself. The cold seal adhesive, since it adheres (or coheres) only to a similar substrate, does not cause a residue to build up on equipment, thereby permitting much more rapid disposition and use to form articles. A cold seal adhesive differs also from, for example, a pressure sensitive adhesive, in that a cold seal adhesive is not readily releasable.

The term "bonding material" when used herein also includes any heat or chemically shrinkable material, and static electrical or other electrical materials, chemical welding materials, and static electrical or other electrical materials, chemical welding materials, magnetic welding materials, mechanical or barb-type fastening materials or clamps, curl-type characteristics of the film or materials incorporated in material which can cause the material to take on certain shapes, cling films, slots, grooves, shrinkable materials and bands, curl materials, springs, and any type of welding method which may weld portions of the material to itself or to the adjoining material, or to both the material itself and the adjoining material.

Figure 16:
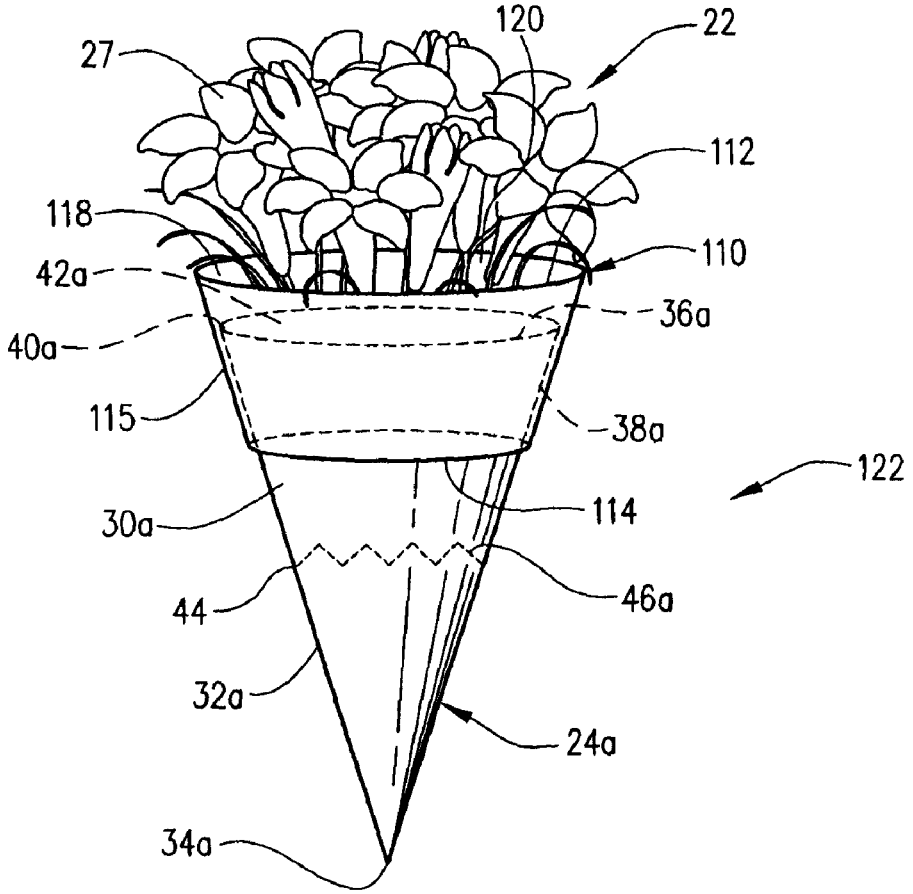
FIG. 16 is a pictorial representation of a decorative assembly which includes the skirt of FIG. 15 disposed about the outer peripheral surface of a bouquet holder constructed in accordance with the present invention.
Figure 17:
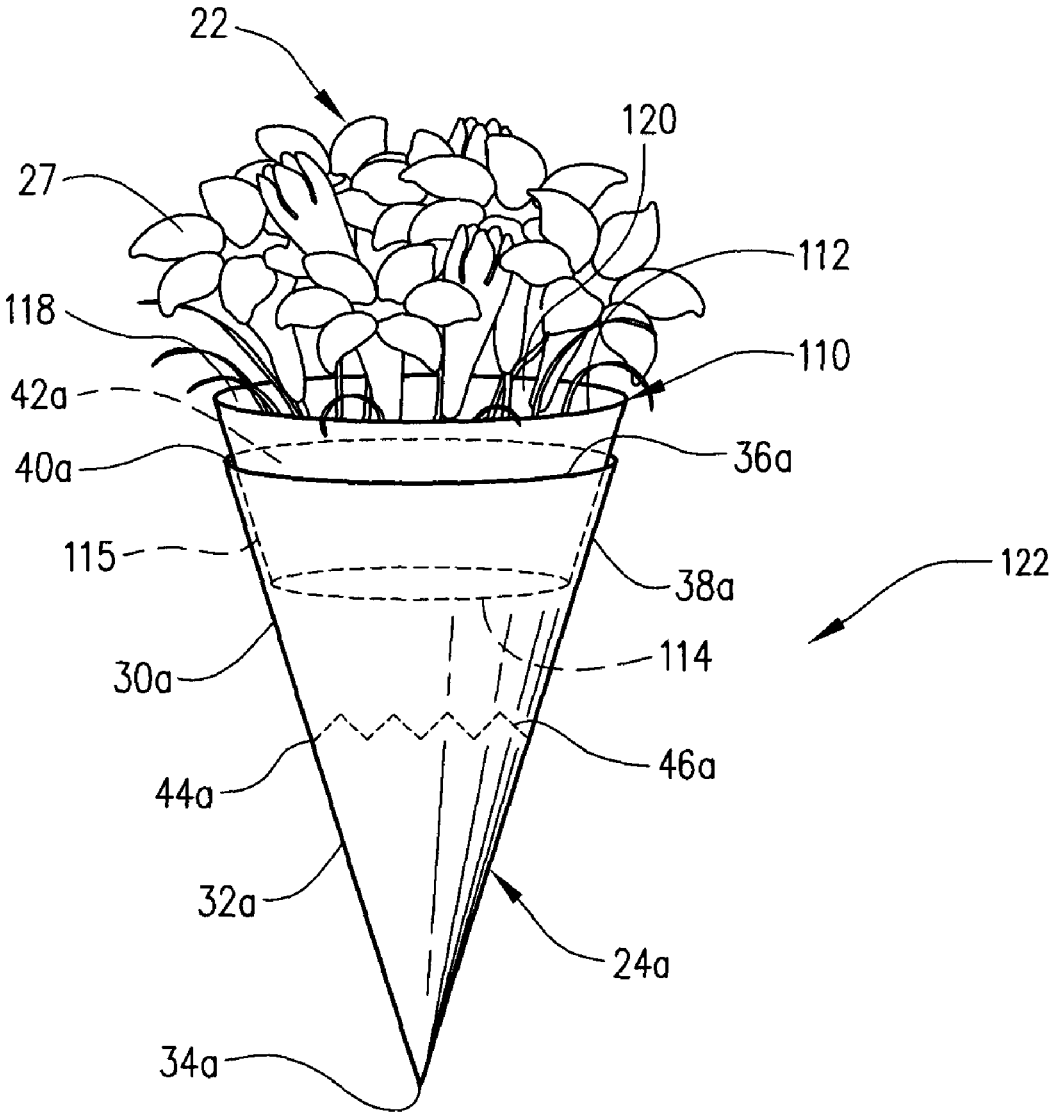
FIG. 17 is a pictorial representation of a decorative assembly which includes the skirt of FIG. 15 disposed about the inner peripheral surface of a bouquet holder constructed in accordance with the present invention.

Referring now to FIGS. 16-17 shown therein is a decorative assembly 122, which includes the skirt 110, disposed about the bouquet holder 24*a*. While the decorative assembly 122 is described below with reference to the bouquet holder 24*a*, it should be noted that the decorative assemblies 122 can be formed from any bouquet holder, including but not limited to the bouquet holder 24, 24*a* or 24*b*.

As shown in FIG. 16 the decorative assembly 122 includes the skirt 110 disposed substantially adjacent to the outer peripheral surface 38*a* of the bouquet holder 24*a*. As shown in FIG. 17, the decorative assembly 122 includes the skirt 110 disposed substantially adjacent to the inner peripheral surface 40*a* of the bouquet holder 24*a*.

As shown in FIGS. 16-17, the floral grouping 22 can be disposed within the internal chamber 120 of the skirt 110 and into the internal chamber 42*a* of the bouquet holder 24*a*. The skirt 110 is disposed about the bouquet holder 24*a* such that a portion of the open lower end 114 of the skirt 110 frictionally engages the bouquet holder 24*a* so that the bouquet holder 24*a* is secured in a stable position. When the skirt 110 is disposed about the bouquet holder 24*a* and the floral grouping 22, a portion of the open upper end 112 of the skirt 110 encircles and protects at least a portion of the bloom portion 27 of the floral grouping 22 while a portion of the open lower end 114 of the skirt 110 encircles a portion of the bouquet holder 24*a*.

Changes may be made in the construction and the operation of the various components, elements and assemblies described herein or in the steps or the sequence of steps of the methods described herein without departing from the spirit and scope of the invention as defined in the following claims.

What is claimed is:

1. A method for wrapping a floral grouping, the method comprising the steps of:

providing a substantially shape-sustaining sheet of material having a substantially circular shape, the substantially shape sustaining sheet of material having an upper surface, a lower surface, a first end portion, a second end portion and a connecting element which connects the first end portion of the substantially shape-sustaining sheet of material to the second end portion of the substantially shape-sustaining sheet of material;

forming the substantially shape-sustaining sheet of material into a substantially frusto-conical shaped bouquet holder by connecting the first end portion of the substantially shape-sustaining sheet of material to the second end portion of the substantially shape-sustaining sheet of material, the bouquet holder having an outer peripheral surface, an inner peripheral surface defining an internal chamber, an open upper end and a lower end, the open upper end having a diameter greater than the diameter of the lower end;

providing a floral grouping; and disposing a portion of the floral grouping into the internal chamber of the bouquet holder through the open upper end of the bouquet holder.

2. The method of claim 1 wherein, in the step of forming the substantially shape-sustaining sheet of material into a substantially frusto-conical shaped bouquet holder the lower end of the bouquet holder is open such that a portion of the floral grouping extends beyond the open lower end of the bouquet holder.

3. The method of claim 1 wherein, in the step of forming the substantially shape-sustaining sheet of material into a substantially frusto-conical shaped bouquet holder the lower end of the bouquet holder is closed such that the internal chamber of the bouquet holder defines a reservoir for confining a liquid.

4. The method of claim 1 wherein, in the step of providing a substantially shape-sustaining sheet of material at least one substantially shape-sustaining sheet of material is connected to at least one substantially shape-sustaining sheet of material to form a pad of substantially shape-sustaining sheets of material such that at least one substantially shape-sustaining sheet of material can be selectively connected to and selectively separated from the pad of substantially shape-sustaining sheets of material.

5. The method of claim 1 wherein, in the step of forming the substantially shape-sustaining sheet of material into a substantially frusto-conical shaped bouquet the bouquet holder further comprises an upper portion, a lower portion and a detaching element for selectively removing the upper portion of the bouquet holder from the lower portion of the bouquet holder.

6. The method of claim 1 wherein, in the step of providing a substantially shape-sustaining sheet of material the substantially shape-sustaining sheet of material is provided with an opening extending therethrough, such that when the substantially shape-sustaining sheet of material is formed into the bouquet holder, the lower end of the bouquet holder is open so that a floral grouping can be partially disposed through the lower end of the bouquet holder.

7. The method of claim 1, further comprising the steps of:

providing a skirt, the skirt having an open upper end, a lower end, an outer peripheral surface and an inner peripheral surface defining an internal chamber; and disposing the skirt about the bouquet holder.

8. The method of claim 7, wherein the skirt is formed of a flexible sheet of material having an upper surface and a lower surface.

9. The method of claim 8, wherein the flexible sheet of material has an opening extending therethrough such that when the flexible sheet of material is formed into the skirt, the lower end of the skirt is open.

10. The method of claim 9, wherein a portion of the skirt is disposed about the inner peripheral surface of the bouquet holder, such that a portion of the skirt is substantially adjacent to the inner peripheral surface of the bouquet holder.

11. The method of claim 9, wherein a portion of the skirt is disposed about the outer peripheral surface of the bouquet holder, such that a portion of the skirt is substantially adjacent to the outer peripheral surface of the bouquet holder.

12. The method of claim 7, wherein the skirt is formed of a sleeve having an open upper end, an open lower end, an outer peripheral surface and an inner peripheral surface defining an internal chamber.

13. The method of claim 12, wherein a portion of the skirt is disposed about the inner peripheral surface of the bouquet holder, such that a portion of the skirt is substantially adjacent to the inner peripheral surface of the bouquet holder.

14. The method of claim 12, wherein a portion of the skirt is disposed about the outer peripheral surface of the bouquet holder, such that a portion of the skirt is substantially adjacent to the outer peripheral surface of the bouquet holder.

15. A method for wrapping a floral grouping, the method comprising the steps of:

providing a substantially shape-sustaining sheet of material having a substantially circular shape, the substantially shape-sustaining sheet of material having an upper surface, a lower surface, a first end portion, a second end portion and a connecting element for connecting the first end portion of the substantially shape-sustaining sheet of material to the second end portion of the substantially shape-sustaining sheet of material;

providing a floral grouping; and forming the substantially shape-sustaining sheet of material about the floral grouping into a substantially frusto-conical shaped bouquet holder by connecting the first end portion of the substantially shape-sustaining sheet of material to the second end portion of the substantially shape-sustaining sheet of material, the bouquet holder having an open upper end, a lower end, an outer peripheral surface and an inner peripheral surface defining an internal chamber, the open upper end having a diameter greater than the diameter of the lower end.

16. The method of claim 15 wherein, in the step of forming the substantially shape-sustaining sheet of material about the floral grouping into a substantially frusto-conical shaped bouquet holder, the lower end of the bouquet holder is open such that a portion of the floral grouping extends beyond the open lower end of the bouquet holder.

17. The method of claim 15 wherein, in the step of forming the substantially shape-sustaining sheet of material about the floral grouping into a substantially frusto-conical shaped bouquet holder, the lower end of the bouquet holder is closed such that the internal chamber of the bouquet holder defines a reservoir for confining a liquid.

18. The method of claim 15 wherein, in the step of providing a substantially shape-sustaining sheet of material, at least one substantially shape-sustaining sheet of material is connected to at least one substantially shape-sustaining sheet of material to form a pad of substantially shape-sustaining sheets of material such that at least one substantially shape-sustaining sheet of material can be selectively connected to and selectively separated from the pad of substantially shape-sustaining sheets of material.

19. The method of claim 15 wherein, in the step of forming the substantially shape-sustaining sheet of material about the floral grouping into a substantially frusto-conical shaped bouquet holder, the bouquet holder further comprises an upper portion, a lower portion and a detaching element for selectively removing the upper portion of the bouquet holder from the lower portion of the bouquet holder.

20. The method of claim 15 wherein, in the step of providing a substantially shape-sustaining sheet of material, the substantially shape-sustaining sheet of material is provided with an opening extending therethrough, such that when the substantially shape-sustaining sheet of material is formed into the bouquet holder, the lower end of the bouquet holder is open so that a floral grouping can be partially disposed through the lower end of the bouquet holder.

21. The method of claim 15, further comprising the steps of:

providing a skirt, the skirt having an open upper end, a lower, end, an outer peripheral surface and an inner peripheral surface defining an internal chamber; and disposing the skirt about the bouquet holder.

22. The method of claim 21, wherein the skirt is formed of a flexible sheet of material having an upper surface and a lower surface.

23. The method of claim 22, wherein the flexible sheet of material has an opening extending therethrough, such that when the flexible sheet of material is formed into the skirt, the skirt has an open lower end.

24. The method of claim 23, wherein a portion of the skirt is disposed about the inner peripheral surface of the bouquet holder, such that a portion of the skirt is substantially adjacent to the inner peripheral surface of the bouquet holder.

25. The method of claim 23, wherein a portion of the skirt is disposed about the outer peripheral surface of the bouquet holder, such that a portion of the skirt is substantially adjacent to the outer peripheral surface of the bouquet holder.

26. The method of claim 21, wherein the skirt is formed of a sleeve having an open upper end, an open lower end, an outer peripheral surface, and an inner peripheral surface defining an internal chamber.

27. The method of claim 26, wherein a portion of the skirt is disposed about the inner peripheral surface of the bouquet holder, such that a portion of the skirt is substantially adjacent to the inner peripheral surface of the bouquet holder.

28. The method of claim 26 wherein a portion of the skirt is disposed about the outer peripheral surface of the bouquet holder, such that a portion of the skirt is substantially adjacent to the outer peripheral surface of the bouquet holder.

* * * * *